US008534269B2

(12) United States Patent
Wilson et al.

(10) Patent No.: US 8,534,269 B2
(45) Date of Patent: Sep. 17, 2013

(54) COMPOUND ARCHERY BOW WITH REPLACEABLE DRAW LENGTH ADJUSTMENT MODULES

(76) Inventors: Dennis Anthony Wilson, Kathleen, GA (US); Rex F. Darlington, Whittemore, MI (US)

( * ) Notice: Subject to any disclaimer, the term of this patent is extended or adjusted under 35 U.S.C. 154(b) by 592 days.

(21) Appl. No.: 12/658,984

(22) Filed: Feb. 18, 2010

(65) Prior Publication Data

US 2010/0147276 A1 Jun. 17, 2010

Related U.S. Application Data

(60) Provisional application No. 61/156,495, filed on Feb. 28, 2009.

(51) Int. Cl.
*F41B 5/10* (2006.01)
*F41B 5/14* (2006.01)

(52) U.S. Cl.
CPC ..... *F41B 5/105* (2013.01); *Y10S 124/90* (2013.01)
USPC ..... 124/25.6; 124/900

(58) Field of Classification Search
CPC ..... F41B 5/105
USPC ..... 124/25.6, 86, 88, 90, 23.1, 900
See application file for complete search history.

(56) References Cited

U.S. PATENT DOCUMENTS 4,519,374 A * 5/1985 Miller ..... 124/25.6
4,562,824 A * 1/1986 Jennings ..... 124/25.6
5,890,480 A * 4/1999 McPherson ..... 124/25.6
5,975,067 A * 11/1999 Strother ..... 124/25.6
6,082,347 A * 7/2000 Darlington ..... 124/25.6
6,247,466 B1 * 6/2001 McPherson ..... 124/25.6
6,516,790 B1 * 2/2003 Darlington ..... 124/25.6

(Continued)

OTHER PUBLICATIONS

U.S. Appl. No. 12/290,750, filed Nov. 3, 2008 Inventor: Rex F. Darlington 24pgs.

(Continued)

*Primary Examiner* — Gene Kim
*Assistant Examiner* — Alexander Niconovich
(74) *Attorney, Agent, or Firm* — Reising Ethington PC

(57) ABSTRACT

A compound archery bow includes a bow handle having projecting limbs, and first and second pulleys mounted on the limbs for rotation around respective axes. A bowstring cable extends from a bowstring anchor through a bowstring let-out groove on the first pulley and then toward the second pulley. A first power cable extends from a first power cable anchor toward the second pulley, and a second power cable extends from the second pulley through a power cable take-up arrangement on the first pulley to a second power cable anchor on the first pulley. A set of at least first and second bowstring cable draw length adjustment modules is provided for alternate mounting on the first pulley to adjust draw length of the bowstring cable away from the handle. Each of the modules includes a first portion for mounting adjacent to the first axis, an intermediate portion that includes a power cable take-up groove that constitutes at least part of the power cable take-up arrangement on the first pulley, and a heel portion for mounting spaced from the first axis and adjacent to the power cable anchor such that the power cable take-up groove extends around the heel to a position adjacent to the power cable anchor. The heel is larger on one of the modules than on the other.

24 Claims, 9 Drawing Sheets

(56) References Cited

U.S. PATENT DOCUMENTS

| | | | | |
|---|---|---|---|---|
| 6,688,295 | B1 * | 2/2004 | Miller | 124/25.6 |
| 6,691,692 | B1 * | 2/2004 | Adkins | 124/25.6 |
| 6,871,643 | B2 * | 3/2005 | Cooper et al. | 124/25.6 |
| 6,990,970 | B1 * | 1/2006 | Darlington | 124/25.6 |
| 6,994,079 | B1 * | 2/2006 | Darlington | 124/25.6 |
| 7,188,615 | B2 * | 3/2007 | Chang | 124/25.6 |
| 7,305,979 | B1 * | 12/2007 | Yehle | 124/25.6 |
| 7,441,555 | B1 * | 10/2008 | Larson | 124/25.6 |
| 7,997,259 | B2 * | 8/2011 | Wilson | 124/25.6 |
| 8,006,679 | B2 * | 8/2011 | Strother | 124/25.6 |
| 8,205,607 | B1 * | 6/2012 | Darlington | 124/25.6 |
| 8,220,446 | B2 * | 7/2012 | Batdorf | 124/25.6 |
| 8,276,574 | B1 * | 10/2012 | Wilson | 124/25.6 |
| 8,281,774 | B2 * | 10/2012 | Grace | 124/25.6 |
| 2008/0135032 | A1 * | 6/2008 | Islas | 124/90 |
| 2009/0188482 | A1 * | 7/2009 | Strother | 124/25.6 |
| 2009/0255520 | A1 * | 10/2009 | Strother | 124/25.6 |
| 2009/0288650 | A1 * | 11/2009 | Batdorf | 124/25.6 |
| 2009/0320816 | A1 * | 12/2009 | Strother | 124/25.6 |
| 2011/0271939 | A1 * | 11/2011 | Strother | 124/25.6 |

OTHER PUBLICATIONS

U.S. Appl. No. 12/459,316, filed Jun. 30, 2009 Inventor: Rex F. Darlington 16pgs.

* cited by examiner

FIGURE 1A
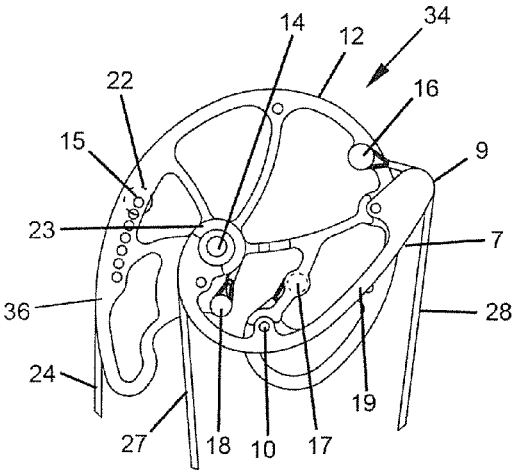
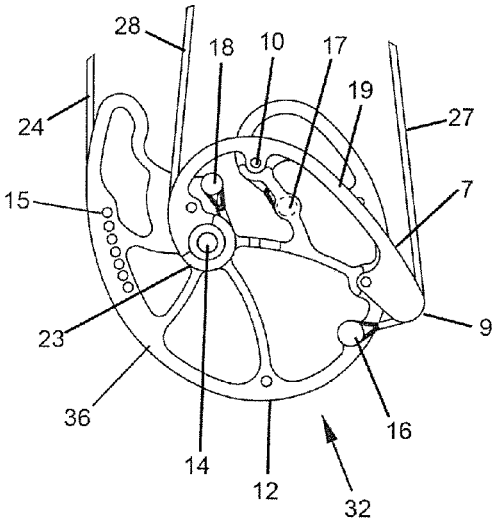
FIGURE 1B
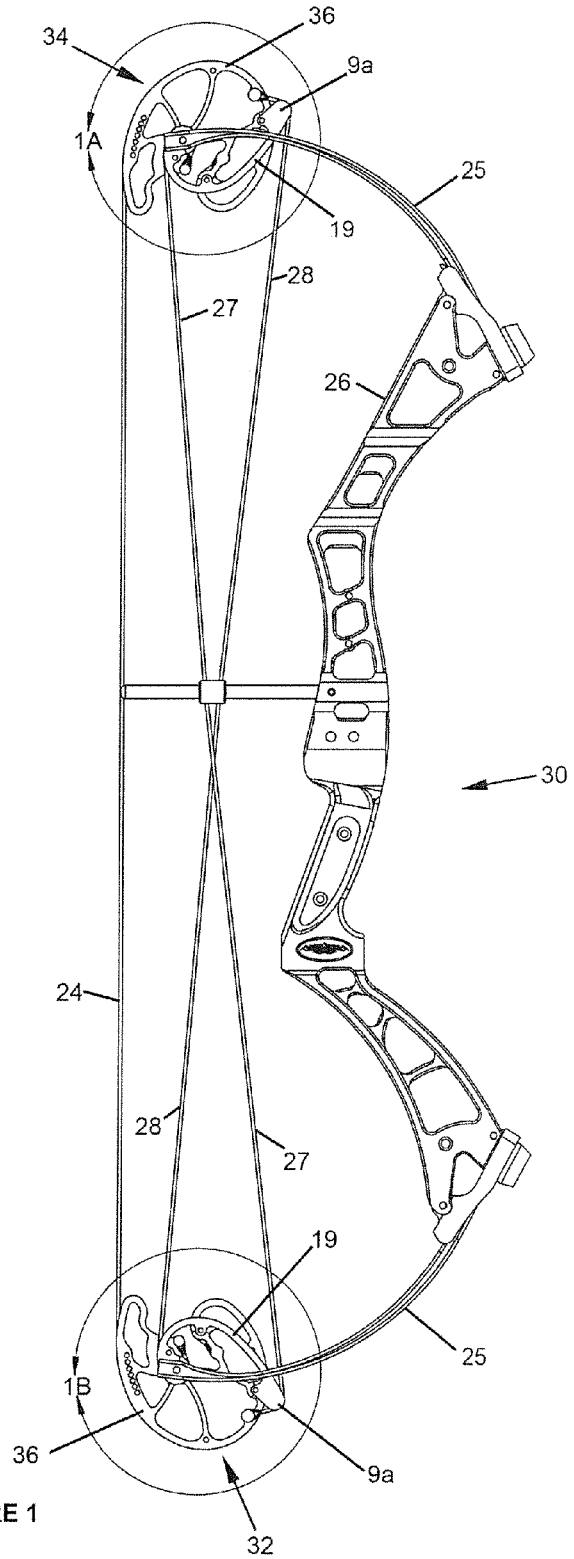
FIGURE 1

FIGURE 3A
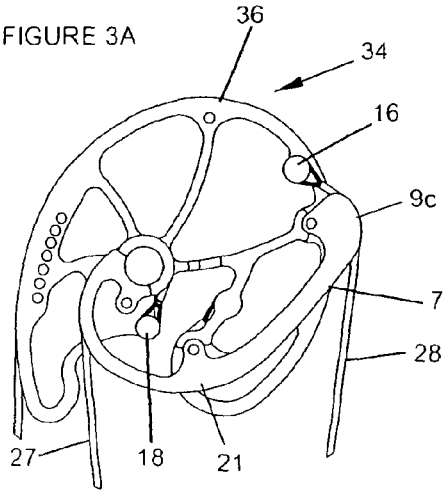
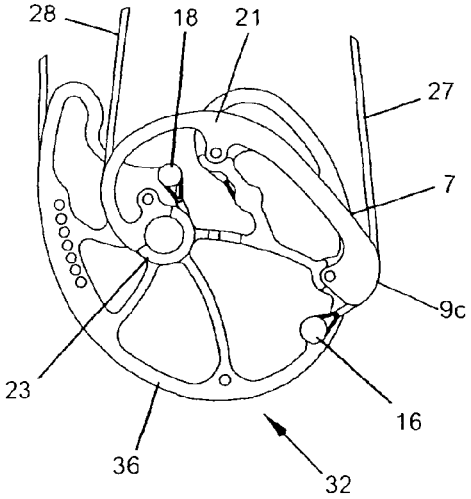
FIGURE 3B
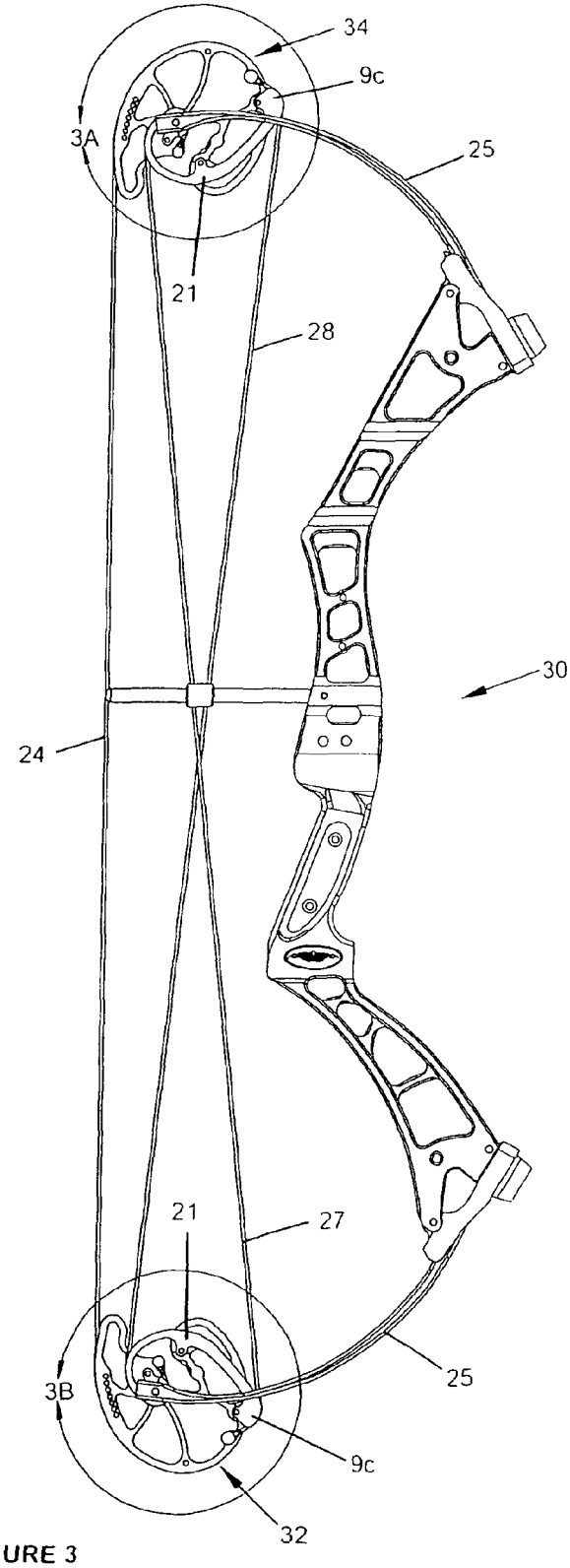
FIGURE 3

COMPOUND ARCHERY BOW WITH REPLACEABLE DRAW LENGTH ADJUSTMENT MODULES

This application claims priority from U.S. application 61/156,495 filed Feb. 28, 2009.

The present disclosure relates to compound archery bows having pulleys at the ends of the bow limbs to control the force/draw characteristics of the bow, and more particularly to compound archery bows having a draw length module removably mounted on at least one of the pulleys for adjusting bow draw length.

BACKGROUND AND SUMMARY OF THE DISCLOSURE

Single-cam and dual-cam compound archery bows have a power cam mounted on one or both ends of the bow limbs to control the draw force on the bowstring and the bending of the bow limbs as the bowstring is drawn. In single-cam bows, there is a power cam on the end of one bow limb with two let-out groves to facilitate let-out of bowstring as the bow is drawn, and a power take-up groove to take up a cable that can be anchored to the axle of a single groove idler wheel located on the opposite limb. In dual-cam bows, power cams are mounted on the ends of both limbs, with each including grooves or groove segments to control let-out of the bowstring on the opposing cam and power take-up grooves to take up cable that can be anchored at its opposing cam axle. More recently there have been hybrid cam systems that incorporate a mixture of both systems; there is a power cam on the end of one bow limb, and a two groove wheel on the end of the other bow limb to facilitate control or time take-up of a power cable at the power cam, and let-out of bowstring and control cables at the power cam as the bowstring is drawn. The power cam or cams may include a draw length control module adjustably and/or removably mounted on the power cam for adjusting the draw length of the bow.

In conventional bows of the described character having one or more adjustably or replaceably mounted draw length modules, adjustment and/or replacement of the module(s) can be made without concern for cable length because the power cable typically is anchored independently of its cam to an axle of the cam or wheel opposite its take-up and its effective length is not affected when draw length modules are changed to alter draw length. More recently there has been a new two-cam design where the power cable groove has both a let-out portion and a take-up portion on each cam. When modules are used to change draw length with this cam system, there is a problem with increasing cable slack as the draw length is decreased. A way to address this situation is to change power cables when the bow draw length is adjusted. A general object of the present disclosure is to provide a compound archery bow with draw length adjustment modules that automatically compensate for slackening that would otherwise occur in the power cable(s) as the draw length is adjusted.

The present disclosure embodies a number of aspects that can be implemented separately from or in combination with each other.

A compound archery bow in accordance with one aspect of the present disclosure includes a bow handle having projecting limbs, and first and second pulleys mounted on the limbs for rotation around respective axes. A bowstring cable extends from a bowstring anchor through a bowstring let-out groove on the first pulley and then toward the second pulley. A first power cable extends from a first power cable anchor toward the second pulley, and a second power cable extends from the second pulley through a power cable take-up arrangement on the first pulley to a second power cable anchor on the first pulley. Draw of the bowstring cable away from the handle lets out bowstring cable from the bowstring let-out groove, rotates the first pulley around the first axis, and takes up the second power cable into the second power cable take-up arrangement on the first pulley. A set of at least first and second bowstring cable draw length adjustment modules is provided for alternate mounting on the first pulley to adjust draw length of the bowstring cable away from the handle. Each of the modules includes a first portion for mounting adjacent to the first axis, an intermediate portion that includes a power cable take-up groove that constitutes at least part of the power cable take-up arrangement on the first pulley, and a heel portion for mounting spaced from the first axis and adjacent to the power cable anchor such that the power cable take-up groove extends around the heel to a position adjacent to the power cable anchor. The heel is larger on one of the modules than on the other.

A compound archery bow in accordance with another aspect of the present disclosure includes a bow handle having projecting limbs, and first and second pulleys mounted on the limbs for rotation around respective axes. A bowstring cable extends from a bowstring anchor through a bowstring let-out groove on the first pulley and then toward the second pulley. A first pulley power cable let-out portion of a power cable groove extends a power cable from the first pulley toward the second pulley take-up portion of the power cable groove, and a second pulley power cable let-out portion of the power cable groove extends a power cable from the second pulley to a power cable take-up arrangement on the first pulley. Draw of the bowstring cable away from the handle lets out bowstring cable from the bowstring let-out groove, rotates the first pulley around the first axis as it lets out the first power cable and takes up the second power cable into the second power cable take-up arrangement on the first pulley and rotates the second pulley around the second axis as it lets out the second power cable and takes up the first power cable into the first power cable take-up arrangement on the second pulley. A set of at least first and second bowstring cable draw length adjustment modules is provided for alternate mounting on the pulleys to adjust draw length of the bowstring cable away from the handle. Each of the modules includes a first portion for mounting adjacent to the first axis, an intermediate portion that includes a power cable take-up groove that constitutes at least part of the power cable take-up arrangement on the first pulley, and a heel portion for mounting spaced from the first axis and adjacent to the power cable anchor such that the power cable take-up groove extends around the heel to a position adjacent to the power cable anchor. In accordance with this aspect of the present disclosure, the size varies from one set to another and becomes larger as the draw length becomes shorter.

BRIEF DESCRIPTION OF THE DRAWINGS

The disclosure, together with additional objects, features, advantages and aspects thereof, will best be understood from the following description, the appended claims and the accompanying drawings, in which:

FIG. 1 is a side elevational view of a compound archery bow in accordance with one exemplary embodiment of the present disclosure;

FIGS. 1A and 1B are fragmentary enlarged elevational views of the portions of FIG. 1 within the areas 1A and 1B respectively;

FIG. 3 is a side elevational view of the bow of FIGS. 1 and 2 with a third draw length adjustment module mounted on each of the pulleys;

FIGS. 3A and 3B are elevational views on an enlarged scale of the portions of FIG. 3 within the respective areas 3A and 3B;

DETAILED DESCRIPTION OF PREFERRED EMBODIMENTS

Figure 2A:
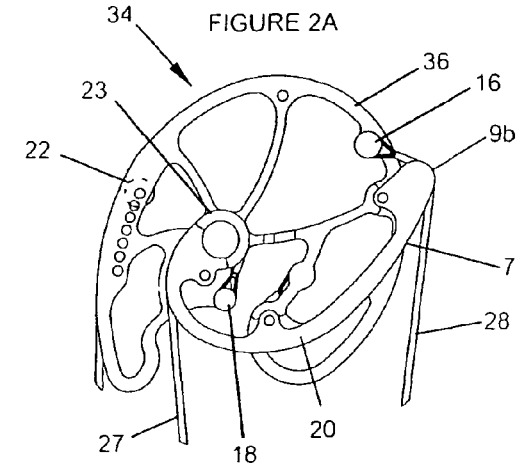
FIGS. 2A and 2B are fragmentary elevational views on an enlarged scale of the portions of FIG. 2 within the respective areas 2A and 2B.

FIG. 1 illustrates a dual-cam compound archery bow 30 in accordance with one exemplary embodiment of the present disclosure as including a handle 26 of aluminum or other relatively rigid construction having spaced risers with limb-mounting surfaces at each end. A pair of flexible resilient limbs 25 of fiber-reinforced resin or other suitable resilient construction are mounted on the respective handle risers and project away from handle 26. A lower pulley 32 (FIGS. 1 and 1B) is mounted on an end of limb 25 for rotation around the axis of an axle 14, and an upper pulley 34 (FIGS. 1 and 1A) is mounted on an end of upper limb 25 for rotation around the axis of an associated axle 14. Bow 30 of FIGS. 1-1B is a dual-cam bow in which pulleys 32, 34 are similar in function and preferably near minor images of each other. (One of the pulleys may be slightly larger than the other to compensate for the handle arrow rest not being at the true center of the bow. Some pulleys also can be made non-identical in areas that are non-functional to create a desired difference in appearance.)

A bowstring cable 24 (FIGS. 1-1B) extends from an anchor 17 (FIGS. 1A, 1B and 6) on upper pulley 34 through a bowstring let-out groove 12 extending around the periphery of pulley 34 and then toward pulley 32. In the exemplary embodiment, bowstring cable 24 extends at pulley 32 (FIG. 1B) through a peripheral bowstring let-out groove 12 to an anchor 17. A first power cable 27 extends from an anchor 18 on pulley 34 around a let-out groove 23 (FIG. 1A) toward pulley 32, and then at pulley 32 through a portion of a cable take-up groove 7 to an anchor 16 (FIG. 1B). A second power cable 28 extends from a power cable let-out groove 23 on pulley 32 toward pulley 34, at which cable 28 extends through a take-up groove 7 to an anchor 16.

Figure 2B:
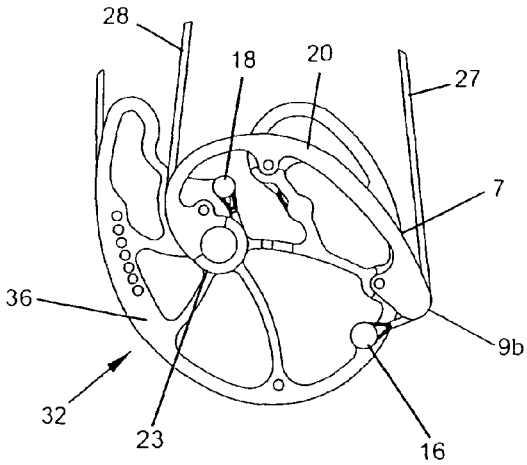
Figure 2:
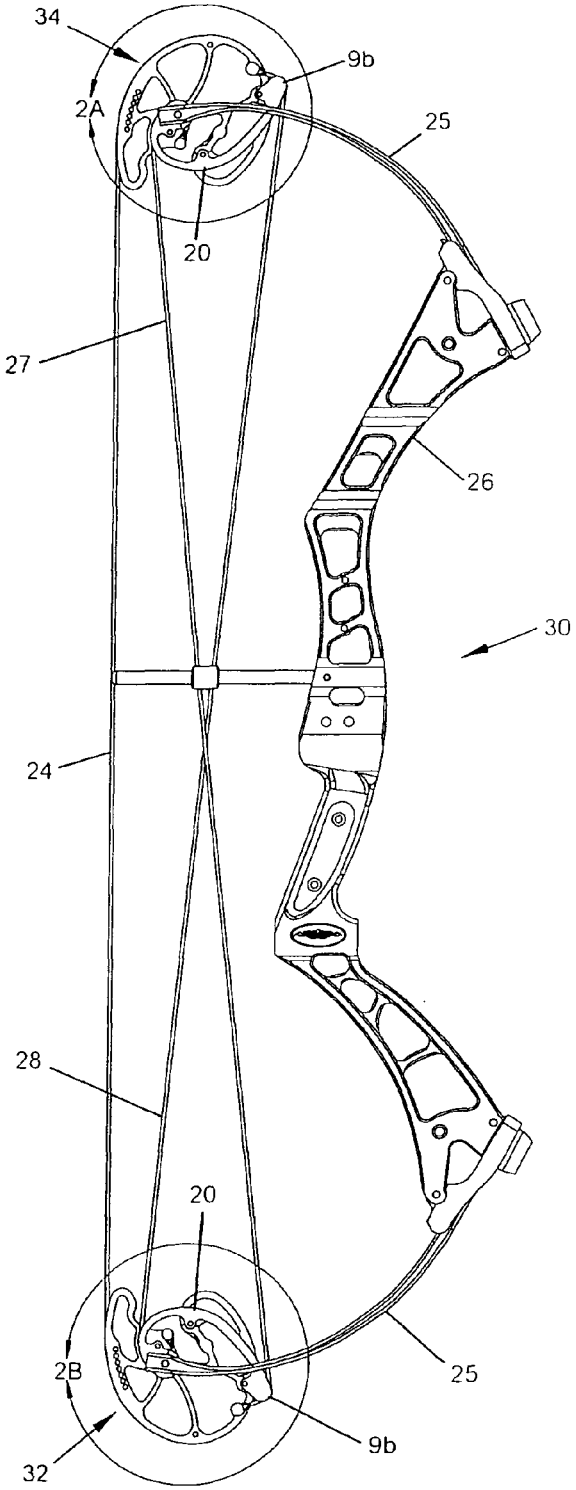
FIG. 2 is a side elevational view of the bow in FIG. 1 with draw length adjustment modules on the pulleys, which are different from those in FIGS. 1-1B.

Upper pulley 34 preferably comprises a generally flat base 36 (FIG. 6) of plastic or, more preferably, metal construction having bowstring let-out groove 12 extending around its periphery. As shown in FIGS. 1-1B and 6, base 36 preferably includes a full or partial hub 38 with a full or partial peripheral groove that forms part of power cable let-out groove 23. A plurality of draw stop adjustment openings 15 are provided for purposes to be described. Power cable anchor 18 and power cable anchor 16 are mounted on base 36, as is bowstring anchor 17 on the reverse side (see FIG. 9A). A plurality of openings 10 are provided for mounting a draw length adjustment module 19 (FIGS. 1-1B and 5A), 20 (FIGS. 2-2B and 5B) or 21 (FIGS. 3-3B and 5C). (Three sets of modules are illustrated for the exemplary embodiment. There are at least two sets for each pulley, and there could be more than three sets for a greater range of adjustment, for example.)

Figure 5A:
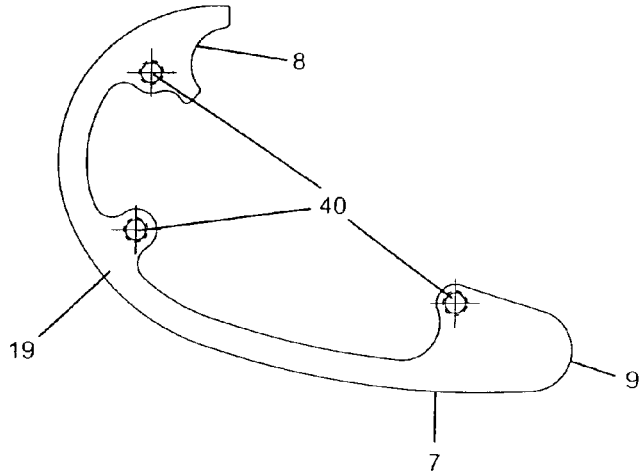
FIGS. 5A-5C are elevational views of the draw length adjustment modules in FIGS. 1-3 respectively.
Figure 5B:
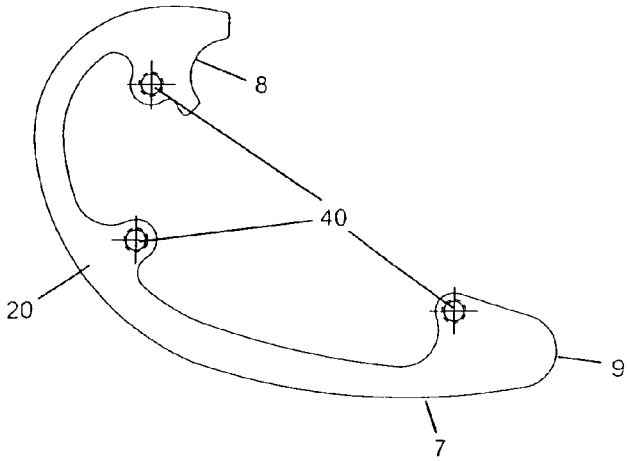
Figure 5C:
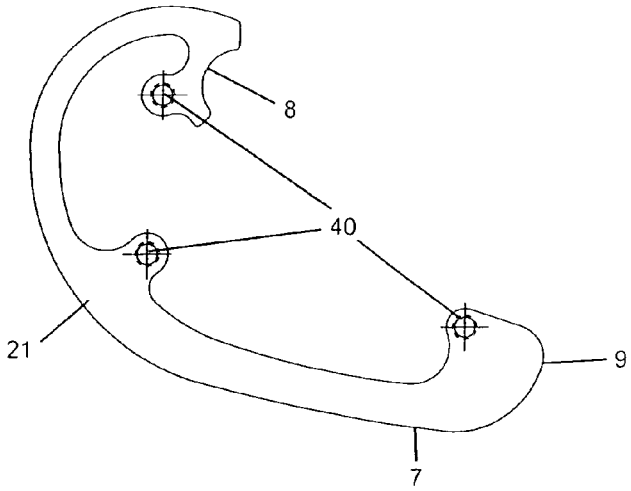
Figure 6:
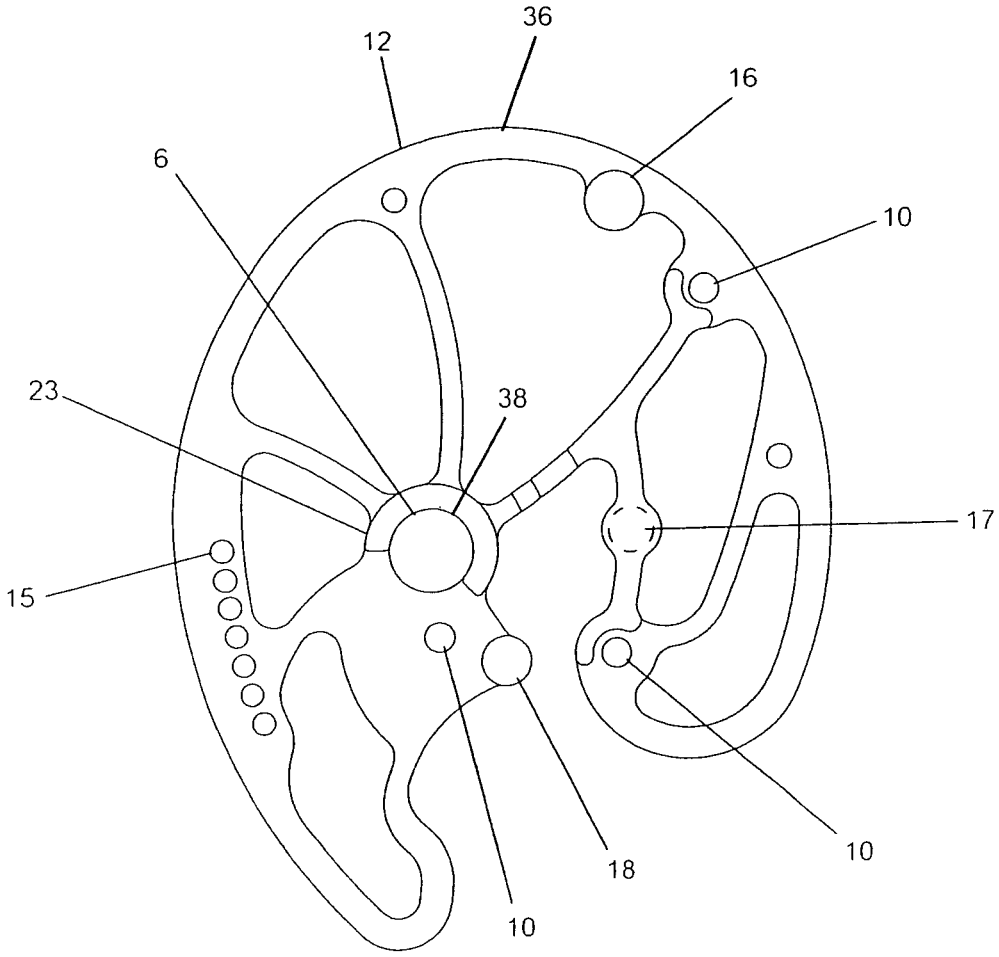
FIG. 6 is an elevational view of the cam base in the upper pulley of FIGS. 1A, 2A and 3A.

Referring now to FIGS. 5A-5C, each draw length module 19, 20, 21 includes a boss 8 for registry with partial or complete hub 38 both for aligning the draw length module on the base and continuing the let-out groove 23 that extends around the hub and boss. From boss 8, groove 7 in each module extends in an arc to a heel 9 remote from the boss. The lengths of the arcs in the several modules and the sizes of the heels are coordinated with the adjustment length associated with each module both for adjusting bowstring draw length and for taking up the associated power cable slack, as will be described. Each module also includes openings 40, preferably internally threaded openings, for alignment with openings 10 in base 36 for removably mounting the modules on the base. FIGS. 1-1B illustrate bow 30 and pulleys 32, 34 with draw length modules 19 mounted on the respective pulleys. The modules 19 are the draw length modules associated with the shortest draw length in this exemplary embodiment, with modules 20 (FIGS. 2-2B and 5B) being medium draw length modules and modules 21 (FIGS. 3-3B and 5C) being long-draw modules. Short draw module 19 has an enlarged heel 9*a* as compared with the medium heel 9*b* on module 20 and the short heel 9*c* on module 21.

Figure 4:
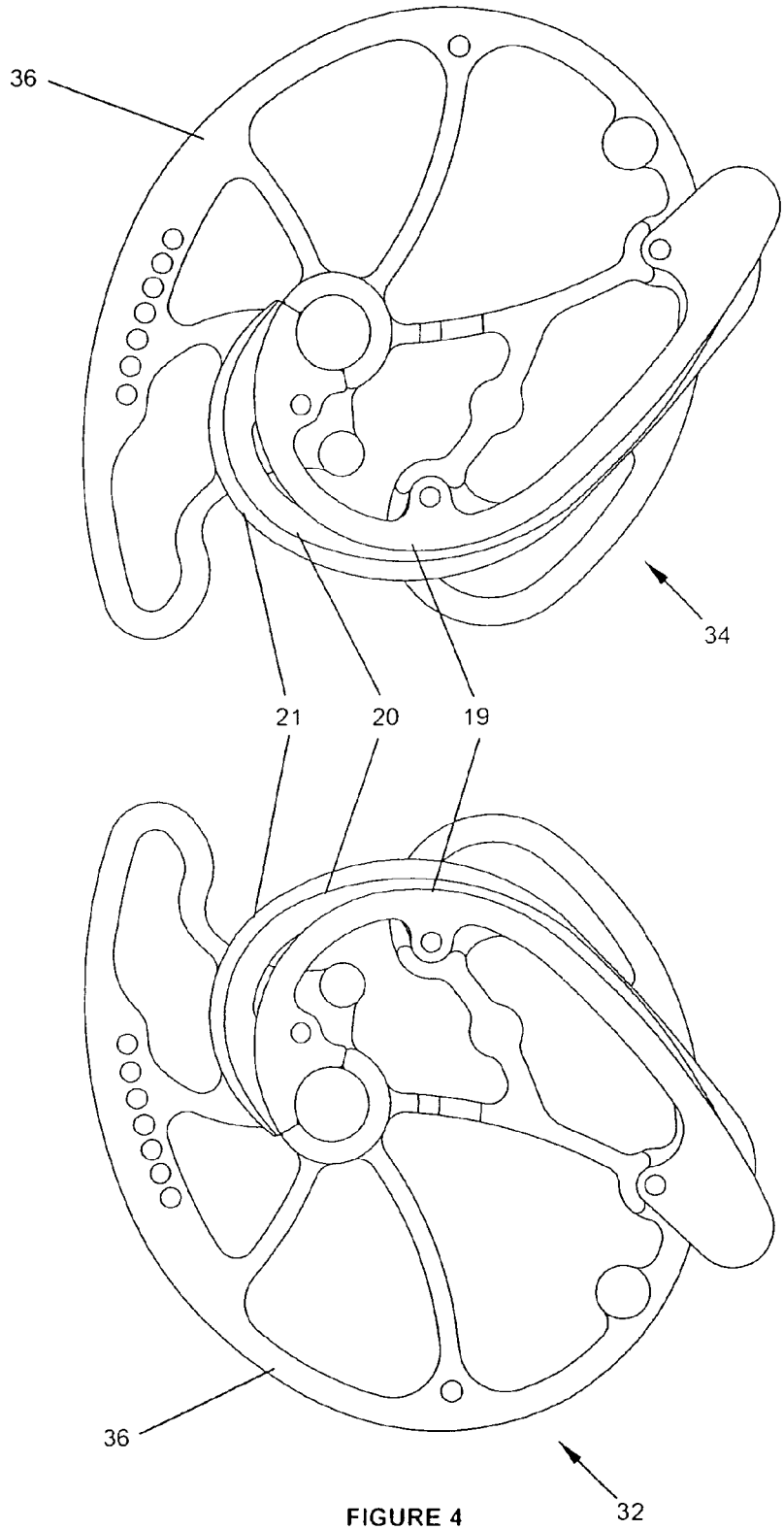
FIG. 4 is a fragmentary elevational view of the upper and lower pulleys in FIGS. 1-3 with all three draw length adjustment modules superimposed for purposes of comparison.

With short-draw module 19 mounted on pulleys 32, 34 as shown in FIGS. 1-1B, cable 28 extends around heel 9*a* to anchor 16 on upper pulley 34 and cable 27 extends around heel 9*a* to anchor 16 on lower pulley 32. As bowstring cable 24 is drawn away from handle 26 from the undrawn condition of FIG. 1 toward the fully drawn condition of FIG. 7, upper pulley 34 rotates counterclockwise in FIG. 1A and lower pulley 32 rotates clockwise in FIG. 1B. The upper end of cable 27 and the lower end of cable 28 are let out from grooves 23 while the upper end of cable 28 and the lower end of cable 27 are taken up into grooves 7 that extend around heels 9*a* on the respective modules. The extended dimensions of heels 9*a* provide extra area for take-up of the power cables to eliminate slack, and may also provide an enhanced lever on the respective pulleys to take up the power cables. Medium-length draw modules 20 in FIGS. 2-2B and 5B have smaller heels 9*b* because the medium-length module requires less taking up of slack in the power cables. Likewise, the long-draw modules 21 in FIGS. 3-3B and 5C have still shorter heels 9*c* because even less slack needs to be taken up when this module is used. FIG. 4 provides a comparison of the geometries of modules 19-21 on pulleys 32, 34. (It will be understood in practice that the modules are mounted individually and not simultaneously on base 36.)

In the bow and module system of FIGS. 1-7, let-out grooves 23 and take-up grooves 7 on each pulley 32, 34 preferably are aligned effectively to form a continuous groove as disclosed in U.S. application Ser. No. 12/290,750, although this is not necessary in accordance with the present disclosure in its broadest aspects.

Figure 7:
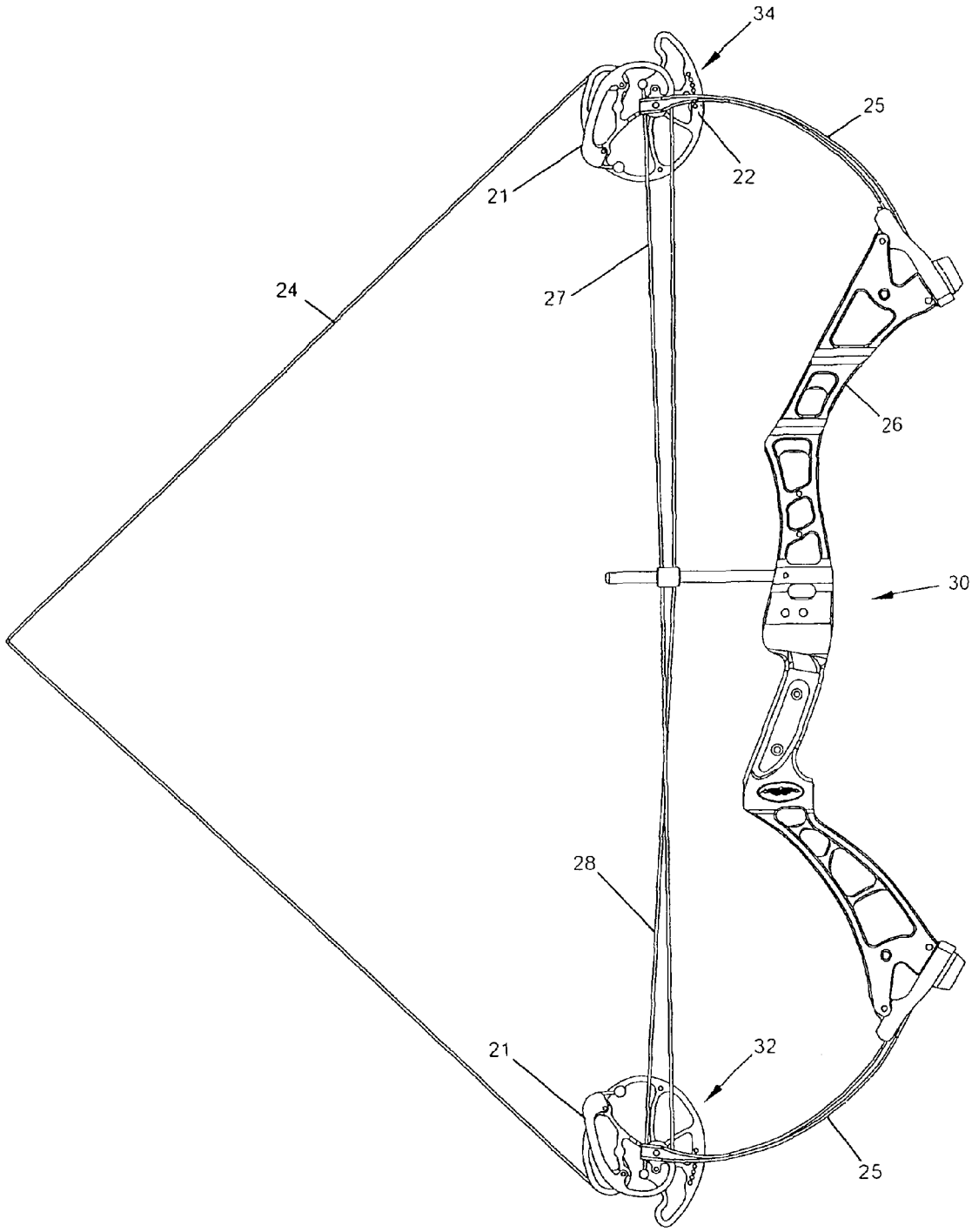
FIG. 7 is a side elevational view of the bow in FIG. 1 in the fully drawn condition.

FIG. 7 is an elevational view of bow 30 in the fully drawn condition and long-draw modules 21 in place. A draw stop post 22 can be adjustably positioned in openings 15 on one or both pulleys to engage one or both limbs. Draw stop post 22 engages bow limb 25 at full draw, as best seen in FIG. 7.

Figures 8, 8A, 8B:
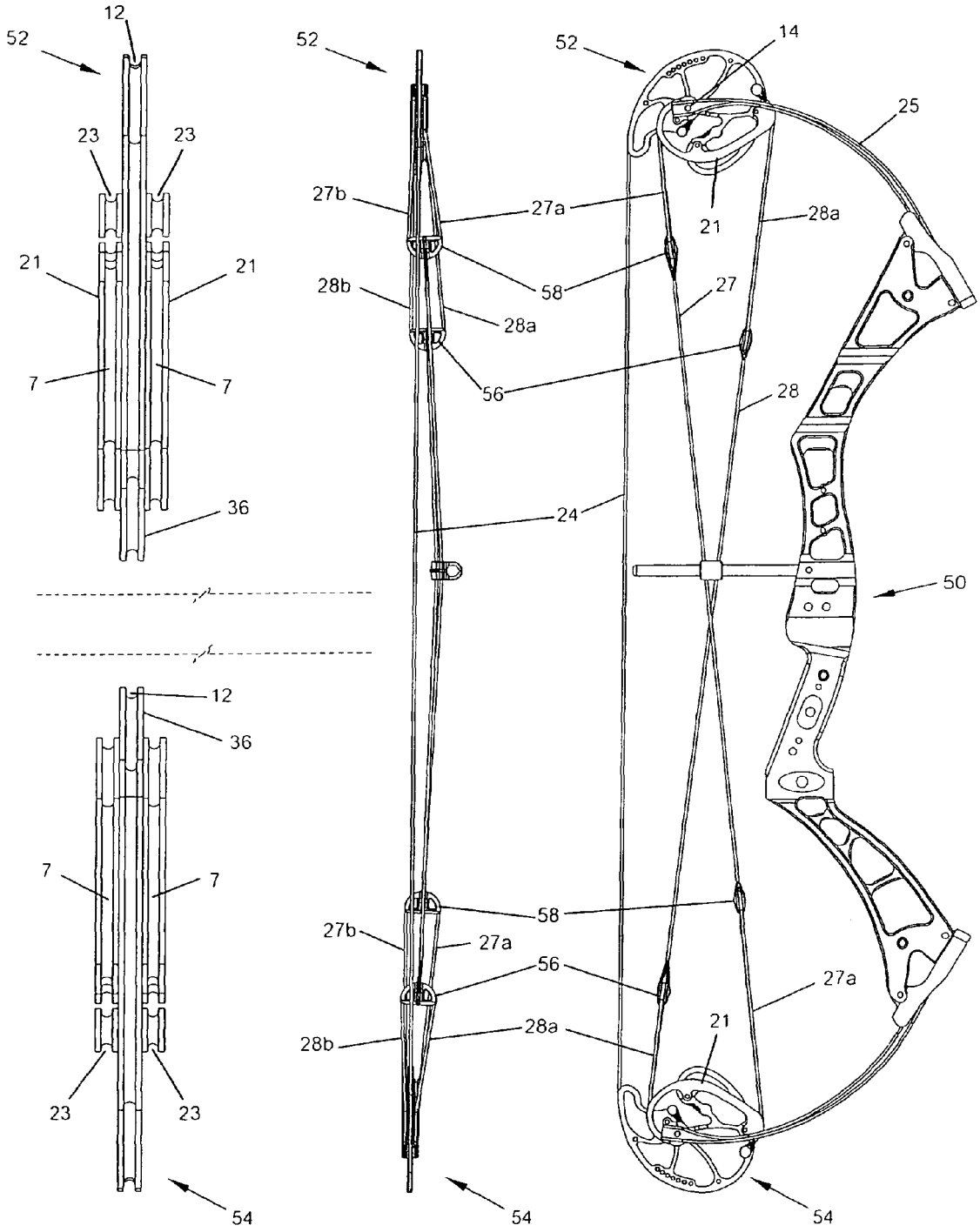
FIG. 8 is a side elevational view of a compound archery bow in accordance with another exemplary embodiment of the present disclosure.
FIG. 8A is an end elevational view of the bow in FIG. 8.
FIG. 8B is a fragmentary elevational view on an enlarged scale of the pulleys in the bow of FIGS. 8 and 8A.

FIGS. 8-8B illustrate a dual-cam bow 50 that is similar in many respects to bow 30 discussed above. Elements of bow 50 (and of bow 60 in FIGS. 9-9C) that are the same as or similar to corresponding elements in bow 30 are indicated by correspondingly identical reference numerals. Only the differences between the bows will be discussed. In bow 50, upper pulley 52 and lower pulley 54 feature draw length modules 21 (or 19 or 20) on both sides of the respective pulleys, rather than on just one side as in FIGS. 1-4. Power cable 28 is coupled by yokes 56 to pairs of split ends 28*a*, 28*b* that are received on respective opposite sides of upper pulley 52 and lower pulley 54. In the same way, power cable 27 is coupled by yokes 58 to split ends 27*a*, 27*b* that are received on respective opposite sides of pulleys 52, 54. This modification helps balance the forces applied to axles 14 and limbs 25.

Figures 9, 9A, 9B, 9C:
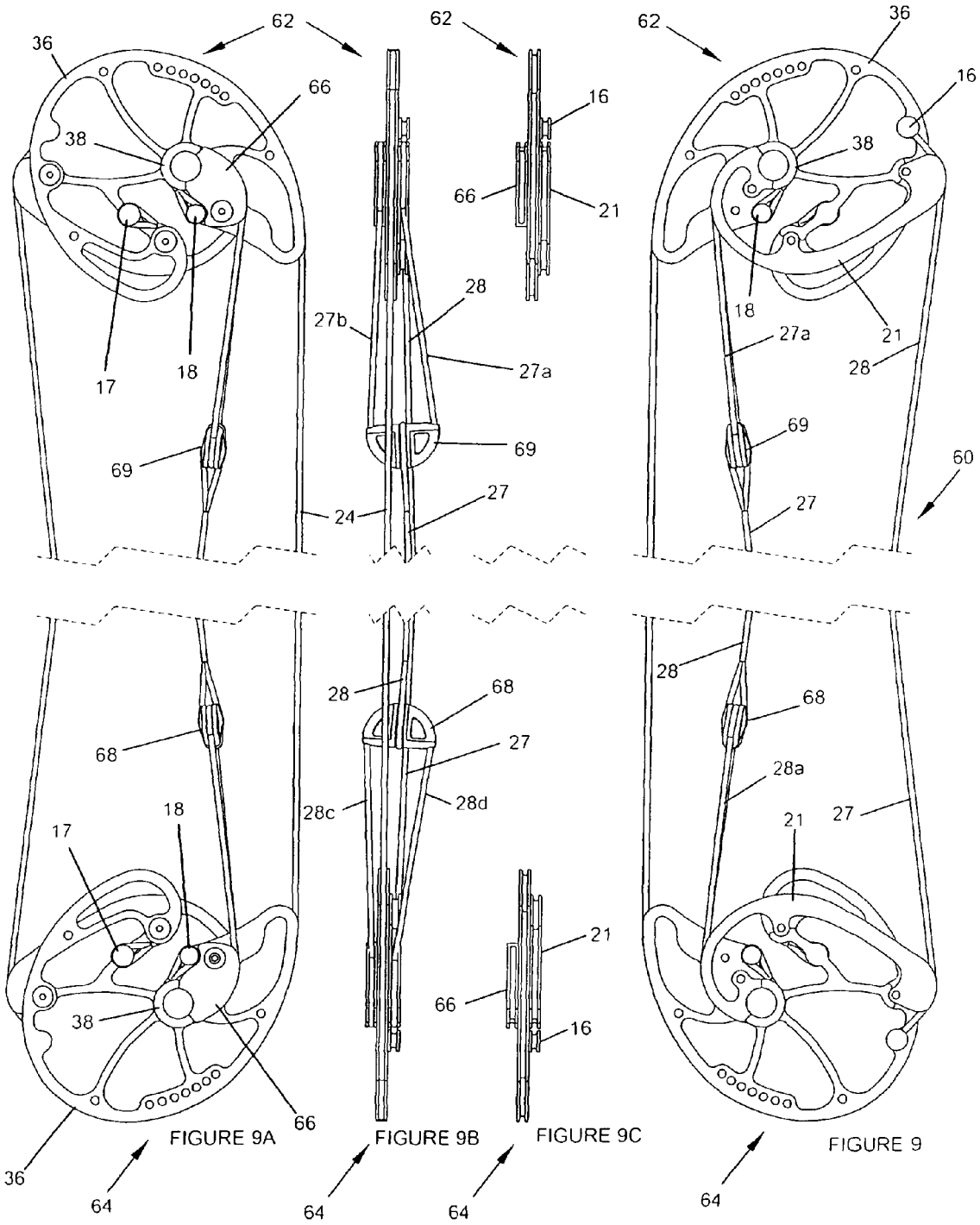
FIG. 9 is a fragmentary side elevational view of pulleys in a compound archery bow in accordance with another exemplary embodiment of the present disclosure with the bow handle and limbs removed for illustration.
FIG. 9A is a fragmentary elevational view of the pulleys in FIG. 9 viewed from the opposite side.
FIG. 9B is an end elevational view of the pulleys in FIG. 9.
FIG. 9C is an end elevational view similar to that of FIG. 9B but with the cables removed for illustration.

FIGS. 9-9C illustrate a compound bow 60 (the bow handle and limbs are not shown for simplicity). In this embodiment, a draw length module 21 (or 19 or 20) is mounted on only one side of upper pulley 62 and lower pulley 64. A power cable let-out groove 66 is mounted on the opposing side of each pulley and can be part of a hub or a module to be changed with the draw length module. Thus, power cable 28 is secured to anchor 16 at upper pulley 62, and extends to a yoke 68 adjacent to lower pulley 64, from which split cable ends 28*c*, 28*d* extend to module 21 and module 66 respectively. In the same way, power cable 27 extends from module 21 on lower pulley 64 to a yoke 69, from which split ends 28*c*, 28*d* extend to module 21 and module 66 on upper pulley 62 respectively. This again helps balance forces on the pulley axles and the bow limbs.

There thus has been disclosed a compound archery bow that fully satisfies all of the objects and aims previously set forth. The bow has been disclosed in conjunction with several exemplary embodiments, and additional modifications and variations have been discussed. A dual cam bow preferably uses a portion of the same grove at each cam for the let-out and take-up of the power cables. The bow uses modules with heel extensions or levers to adjust cable length to take up cable slack without adjusting cable length when changing draw length modules. The bow preferably uses modules that are independent of the axle bosses. In the embodiment of FIGS. 8-8B, there are two power cable let-out grooves and two power cable take-up grooves per cam to help reduce torque on the limbs. In the embodiment of FIGS. 9-9C, there are two power cable let-out grooves and one power cable take-up groove per cam to help reduce torque on the limbs. The boss may use split cables when using two let-outs and one or two take-up grooves. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A compound archery bow that includes:

a bow handle having projecting limbs, a first pulley mounted on a first of said limbs for rotation around a first axis, a second pulley mounted on a second of said limbs for rotation around a second axis, bow cable means including a bowstring cable extending from a bowstring anchor through a bowstring let-out groove on said first pulley and then toward said second pulley, a first power cable extending from a first power cable anchor toward said second pulley, and a second power cable extending from said second pulley through power cable take-up means to a second power cable anchor on said first pulley, such that draw of said bowstring cable away from said handle lets out bowstring cable from said bowstring let-out groove, rotates said first pulley around said first axis, and takes up said second power cable into said power cable take-up means on said first pulley, and a set of at least first and second non-identical bowstring cable draw length adjustment modules for alternate mounting on said first pulley to adjust draw length of said bowstring cable away from said handle, each of said modules including a first portion for mounting adjacent to said first axis, an intermediate portion that includes a power cable take-up groove that constitutes at least part of said power cable take-up means, and a heel portion spaced from said first axis and adjacent to said second power cable anchor when the module is mounted on said first pulley, such that said power cable take-up groove extends around said heel portion to a position adjacent to said power cable anchor, wherein a heel portion on said first module is larger than a heel portion on said second module to enable adjustment of power cable length when changing said modules by taking up slack in the power cables instead of haying to change the power cables.

2. The bow set forth in claim 1 wherein, when one of said modules is mounted on said first pulley, the heel portion on said module extends away from said first axis forming a lever or extension for take-up of said second power cable as said bowstring cable is drawn.

3. The bow set forth in claim 2 wherein said heel portion and said lever or extension are larger on the one of said first and second modules of shorter draw length than on another of said first and second modules of longer draw length.

4. The bow set forth in claim 1 wherein said bow cable means includes a power cable let-out groove through which said first power cable extends from said first anchor toward said second pulley.

5. The bow set forth in claim 4 wherein said power cable let-out groove and said power cable take-up groove together comprise a single groove on said module.

6. The bow set forth in claim 1 wherein said bow is a dual cam bow in which said second pulley is a near mirror image of said first pulley.

7. The bow set forth in claim 6 wherein there are identical draw length adjustment modules on each side of said first and second pulleys reducing torque on said bow limbs as said bowstring cable is drawn.

8. The bow set forth in claim 6 wherein there is only one of said draw length adjustment modules on only one side of each of said pulleys and a different power cable let-out means on the opposing side of each of said pulleys, thereby reducing torque on said bow limbs and axles of said pulleys as said bowstring cable is drawn.

9. The bow set forth in claim 8 wherein said draw length adjustment modules and said power cable let-out means are eccentric.

10. The bow set forth in claim 8 wherein said bow cable means includes a single section of bowstring cable, and each of the first and second power cable includes a first section of cable and a second section of cable shorter than said first section of said cable, the first single section of power cable and the second shorter section of power cable connected by a load balancing cable connector, wherein the shorter first section of power cable passes thru the load balancing cable connector and connects on a first end to a module let-out portion cable terminating post, and connects at a second end on an opposing pulley side to a corresponding let-out portion cable terminating post.

11. The bow set forth in claim 1 wherein said first portion also includes a power cable groove that constitutes a portion of an eccentric power cable let-out means, and said larger heel portion also enables adjustment of pulley orientation and timing when changing said modules.

12. A compound archery bow that includes:

a bow handle having projecting limbs, a first pulley mounted on a first of said limbs for rotation around a first axis, a second pulley mounted on a second of said limbs for rotation around a second axis, bow cable means including a bowstring cable extending from a first bowstring anchor through a bowstring let-out groove on said first pulley and on said second pulley through a first bowstring let-out groove to a second bowstring anchor on said second pulley, a first power cable extending from a first power cable anchor on said first pulley through a let-out portion of a first power cable groove toward said second pulley at which said first power cable extends through a take-up portion of a second power cable groove to a second power cable anchor, and a second power cable extending from a first power cable anchor on said second pulley through a let-out portion of said second power cable groove toward said first pulley at which said second power cable extends through a take-up portion of said first power cable groove to a second power cable anchor, such that draw of said bowstring cable away from said handle lets out said bowstring cable from said bowstring let-out grooves, rotates said first pulley around said first axis as it lets out said first power cable and takes up said second power cable in said first power cable groove, and rotates said second pulley around said second axis as it lets out said second power cable and takes up said first power cable in said second power cable groove, a set of at least first and second pairs of non-identical bowstring cable draw length adjustment modules for alternate mounting on said first and second pulleys to adjust draw length of said bowstring cable away from said handle, each of said modules including a first portion for mounting adjacent to said first axis, an intermediate portion that includes a power cable take-up groove that constitutes at least part of said power cable take-up means, and a heel portion spaced from said first axis and adjacent to said second power cable anchor when the module is mounted on said first pulley, such that said power cable take-up groove extends around said heel portion to a position adjacent to said power cable anchor, said heel portions varying in size from one pair to another and becoming larger as draw length becomes shorter to enable adjustment of power cable length when changing said modules by taking up slack in the power cables instead of haying to change the power cables.

13. The bow set forth in claim 12 wherein, when one pair of said modules are mounted on said pulleys, the heel portions on said modules extends away from said axes forming levers or extensions for take-up of said power cables as said bowstring cable is drawn.

14. The bow set forth in claim 13 wherein said heel portion and said lever or extension are larger on the one of said first and second modules of shorter draw length.

15. The bow set forth in claim 12 wherein said bow is a dual cam bow in which said second pulley is a near mirror image of said first pulley.

16. The bow set forth in claim 15 wherein there are identical draw length adjustment modules on each side of said first and second pulleys reducing torque on said bow limbs as said bowstring cable is drawn.

17. The bow set forth in claim 15 wherein there is only one of said draw length adjustment modules on only one side of each of said pulleys and a different power cable let-out means on the opposing side of each of said pulleys, thereby reducing torque on said bow limbs and axles of said pulleys as said bowstring cable is drawn.

18. The bow set forth in claim 17 wherein said draw length adjustment modules and said power cable let-out means are eccentric.

19. The bow set forth in claim 12 wherein said first portion also includes a power cable groove that constitutes a portion of an eccentric power cable let-out means, and said larger heel portion also enables adjustment of pulley orientation and timing when changing said modules.

20. A set of at least first and second non-identical bowstring cable draw length adjustment modules for alternate mounting on a pulley of a compound archery bow to adjust draw length of the bow, in which:

each of said modules includes a first portion for mounting adjacent to an axis rotation of the pulley, an intermediate portion that includes a power cable take-up groove, and a heel portion spaced from said first portion, said power cable take-up groove extending around said heel portion, said heel portion being larger on said first module than on said second module to enable adjustment of power cable length when changing said modules by taking up slack in the power cables instead of haying to change the power cables.

21. The set forth in claim 20 wherein said first portion also includes a power cable groove that constitutes a portion of an eccentric power cable let-out means, and said larger heel portion also enables adjustment of pulley orientation and timing when changing said modules.

22. Sets of at least first and second non-identical bowstring cable draw length adjustment modules for alternate mounting on first and second near mirror image pulleys of a compound, dual cam, archery bow to adjust draw length of the bow, in which:

each of said modules includes a first portion for mounting adjacent to an axis rotation of the pulley, an intermediate portion that includes a power cable take-up groove, and a heel portion spaced from said first portion, said power cable take-up groove extending around said heel portion, and wherein only one draw length adjustment module is for carriage on only one side of each of said pulleys; and a power cable let-out means, different from said modules, and for carriage on an opposing side of each of said pulleys, thereby reducing torque on said bow limbs and axles of said pulleys as said bowstring cable is drawn; and wherein a heel portion on said first module is larger than a heel portion on said second module to enable adjustment of power cable length when changing said modules by taking up slack in the power cables instead of having to change the power cables.

23. The sets set forth in claim 22 wherein said draw length adjustment modules and said power cable let-out means are eccentric.

24. The sets set forth in claim 22 wherein said first portion also includes a power cable groove that constitutes a portion of an eccentric power cable let-out means.

* * * * *